US007183474B2

(12) United States Patent
Barger

(10) Patent No.: US 7,183,474 B2
(45) Date of Patent: Feb. 27, 2007

(54) ADJUSTABLE SOUNDING BOARD FOR ACOUSTICAL STRINGED INSTRUMENTS

(76) Inventor: Newcomb Barger, 27 C Jordan St., San Rafael, CA (US) 94901

( * ) Notice: Subject to any disclaimer, the term of this patent is extended or adjusted under 35 U.S.C. 154(b) by 201 days.

(21) Appl. No.: 10/938,901

(22) Filed: Sep. 10, 2004

(65) Prior Publication Data

US 2005/0072288 A1 Apr. 7, 2005

Related U.S. Application Data

(60) Provisional application No. 60/507,087, filed on Oct. 1, 2003.

(51) Int. Cl.
*G10D 3/00* (2006.01)

(52) U.S. Cl. ..... 84/290; 84/267

(58) Field of Classification Search ..... 84/290, 84/267, 291, 280, 274–276
See application file for complete search history.

(56) References Cited

U.S. PATENT DOCUMENTS

| | | | | |
|---|---|---|---|---|
| 2,089,629 | A * | 8/1937 | Stowe | 84/294 |
| 3,656,395 | A * | 4/1972 | Kaman | 84/267 |
| 2005/0120859 | A1* | 6/2005 | England | 84/290 |
| 2005/0188814 | A1* | 9/2005 | Bell et al. | 84/298 |

* cited by examiner

*Primary Examiner*—Gary F. Paumen
(74) *Attorney, Agent, or Firm*—H. Michael Brucker

(57) ABSTRACT

A tension adjustable upper sound board for an acoustical stringed musical instrument.

10 Claims, 4 Drawing Sheets

ADJUSTABLE SOUNDING BOARD FOR ACOUSTICAL STRINGED INSTRUMENTS

BACKGROUND OF THE INVENTION

The present invention relates generally to stringed instruments of the acoustical type and, more specifically, to an adjustable upper sounding board for such instruments.

The vibrational relationship in prior art acoustical stringed instruments between the strings, the upper sounding board and the acoustical body is well known and need not be described herein, except to point out that once such an instrument is built, the vibrational characteristics (tension) of the upper sounding board are, for all practical purposes, fixed. That is to say, the voicing of the strings cannot be changed by altering the tension of the sounding board. Thus, for example, the third string of a six-string acoustical guitar, which is typically difficult to voice fully, cannot be more fully voiced by adjusting the tension of the sounding board to create greater voicing for the string.

BRIEF DESCRIPTION OF THE INVENTION

The present invention provides stringed instruments of the acoustical type with mechanical means to change the tension of the sounding board. By the application and variation of pressure, the tension of the upper sounding board can be adjusted by a musician to gain the string voicing that best suits his or her preferences.

More specifically, a voicing bar is disposed adjacent a tapered fan brace between two transverse, sound hole straddling braces on the inner surface of the upper sounding board of an acoustical stringed instrument. In one embodiment of the invention, one end of the voicing bar extends beyond one of the transverse braces and rides on the adjacent tapered fan brace. The voicing bar is movable along its length to vary the location of pressure applied to the tapered fan brace and thereby alter the tension of the sounding board.

In another embodiment, a slider in contact with and applying pressure to the tapered fan brace is slidably disposed on a static voicing bar. By varying the position of the slider, the location and amount of pressure applied to the upper sounding board through the fan brace is altered, which changes the tension of the sounding board and the voicing of the strings.

A further embodiment combines the adjustability of both of the previous embodiments to make for even more refined adjustments.

Accordingly, it is an object of the present invention to provide an acoustical stringed instrument having an upper sounding board with mechanical means able to adjust the tension of the sounding board and thereby the voicing of the strings.

The invention possesses other objects and advantages, especially as concerns particular characteristics and features thereof which will be better understood from the following detailed description of the preferred embodiments when read in conjunction with the appended drawing figures.

DETAILED DESCRIPTION OF THE PREFERRED EMBODIMENTS

The following description of the invention, in its several embodiments, is made with reference to a guitar with the understanding that the invention is also adaptable to other acoustical stringed instruments having a sounding board.

Figure 1:
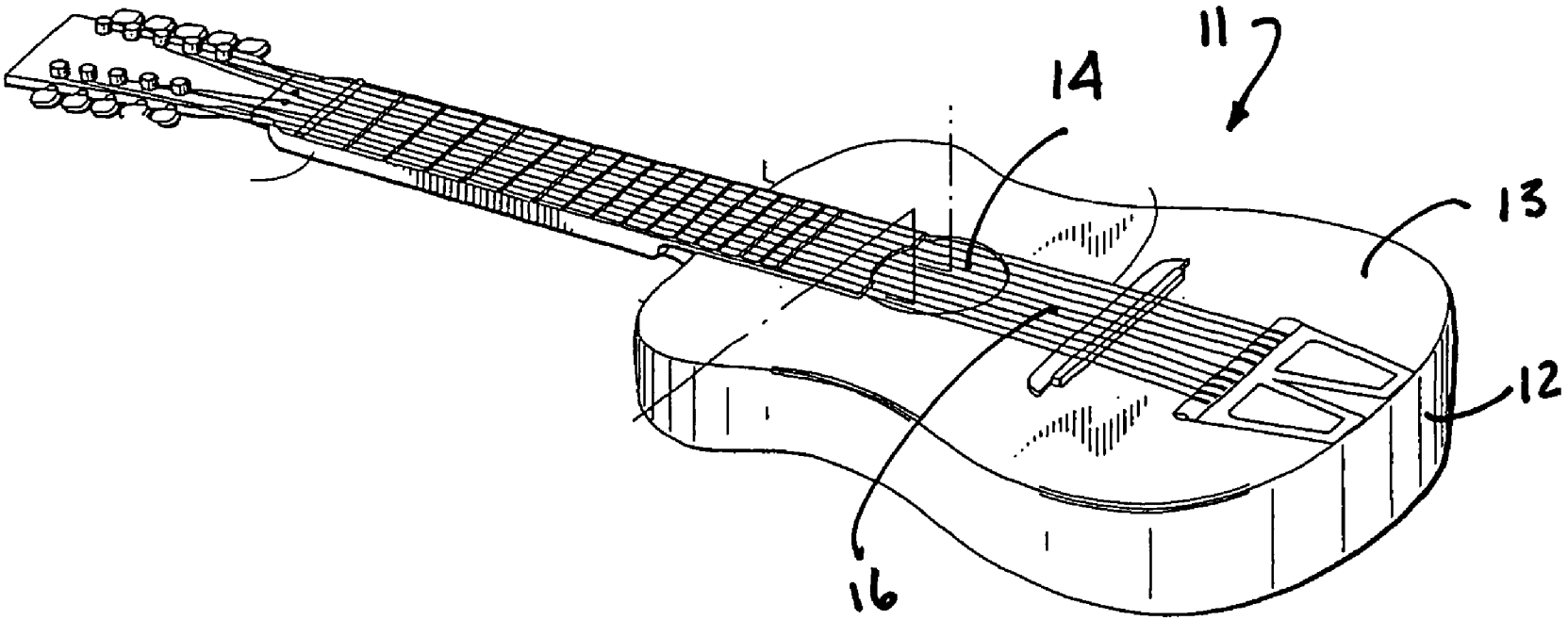
PRIOR ART FIG. 1
FIG. 1 is a perspective view of a typical prior art acoustical guitar.

Referring to FIG. 1, a prior art guitar 11 has a tone box 12 including an upper sounding board 13 with a sound hole 14 over which strings 16 pass. While the size, type and number of strings 16 can be varied and tuned, the tension of the upper sounding board 13 is fixed and not adjustable.

Referring to FIGS. 2–6, attached to the inner surface 17 of a sounding board 18 of a guitar 19 are a pair of transverse braces 21 and 22 which straddle a sound hole 23 in the sounding board 18.

Figure 4:
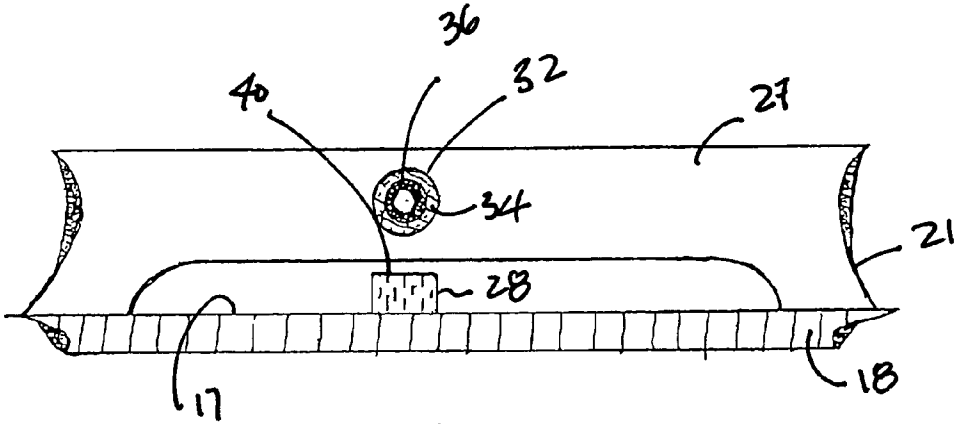
FIG. 4 is a section view taken along the line A—A of FIG. 2.

The transverse brace 21 includes a bridge section 27 that is spaced from the surface 17 of sounding board 18 a sufficient distance to permit a longitudinally extending tapered fan brace 28 to pass thereunder (see FIG. 4). The fan brace 28 is affixed to the inner surface 17 of sounding board 18 adjacent the sound hole 23 and terminates at its thinnest end 29 between the braces and adjacent transverse brace 22. Fan brace 28 extends from its end 29 for some distance beyond transverse brace 21, with the height of the fan brace, as measured from the sounding board inner surface 17, increasing steadily along its length from end 29.

A bearing hole 32 in transverse brace 21 in line with fan brace 28 and a bearing hole 33 in transverse brace 22 in line with fan brace 28 provide bearings for a voicing bar 36 having ends 35*a* and 35*b* and a longitudinal axis 35*c*. The voicing bar 36 is slidably secured within the transverse brace holes 32 and 33 by bushings 34. The bushings 34, which can be made of felt or other suitable material, not only slidably secure the voicing bar 36 in place, but also dampen any unwanted vibration of the voicing bar that might be induced when the guitar is played. The voicing bar 36 is advantageously formed of carbon fiber tubing, but other materials, both solid and tubular, could also be used.

Figure 2:
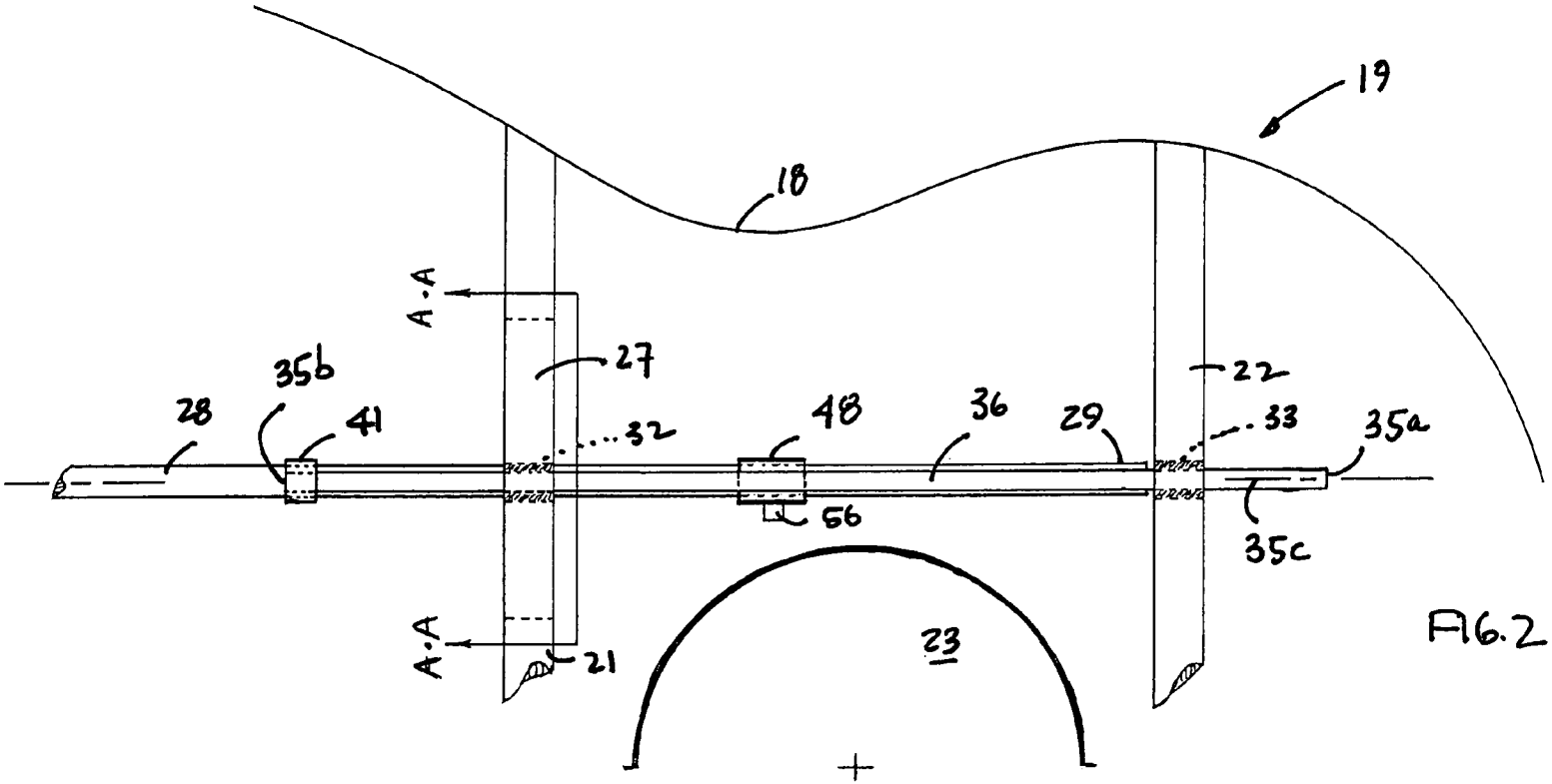
FIG. 2 is a partial plan view of the inner side of an upper sounding board for an acoustical guitar of the present invention.
Figure 3:
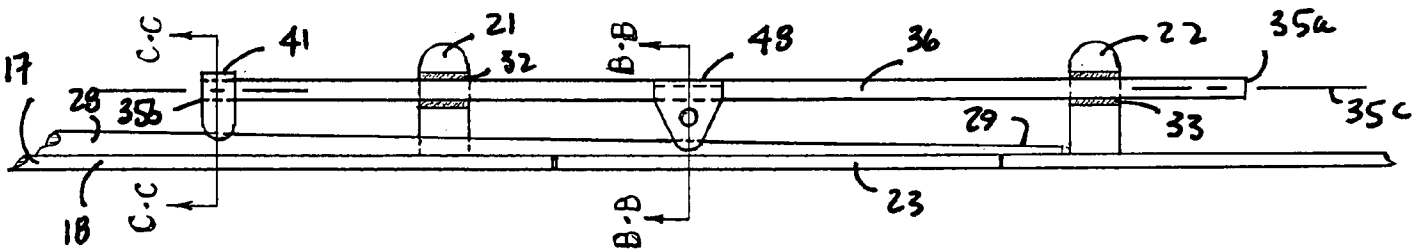
FIG. 3 is a partial side elevation of the sounding board of FIG. 2.
Figure 6:
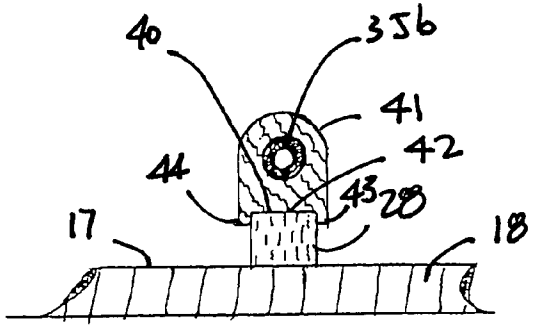
FIG. 6 is a section view taken along the line C—C of FIG. 3.

As best seen in FIGS. 2, 3 and 6, a voicing bar shoe 41 is secured to the end 35*b* of voicing bar 36 that extends beyond transverse brace 21. The shoe 41 extends toward and engages fan brace 28 on which it slides. A recessed surface 42 in the end of shoe 41 engages the upper surface 40 of fan brace 28, while depending legs 43 and 44 on either side of recess 42 assure alignment between the shoe 41 and fan brace 28 as the shoe slides along the fan brace surface 40. The bearing holes 32 and 33 in transverse braces 21 and 22, respectively, are generally the same distance from the surface 17 of sounding board 18 whereby voicing bar 36 is generally parallel to the inner surface 17 of sounding board 18. The position of voicing bar shoe 41 on fan brace 28 can be changed by sliding voicing bar 36 along its longitudinal axis 35*c* in bearing holes 32 and 33. Voicing bar shoe 41 applies pressure on the fan brace 28 and thereby the sounding board 18, effecting a change in the tension of the upper sounding board 18. As the shoe 41 is positioned on the tapered fan brace 28 by sliding voicing bar 36 in the bearing holes 32 and 33, the location of the pressure applied by the shoe changes while the amount of pressure remains fairly constant. As the distance of the shoe 41 from brace 21 increases, so, too, does the thickness of fan brace 28 which would increase the pressure, except that, at the same time, the length of the moment arm between brace 21 and shoe 41 increases, producing greater flexibility. Thus, the movement of voicing bar 36 permits essentially the same pressure to be applied by shoe 41 to various locations on fan brace 28, causing changes in the tension of the sounding board 18.

Figure 5:
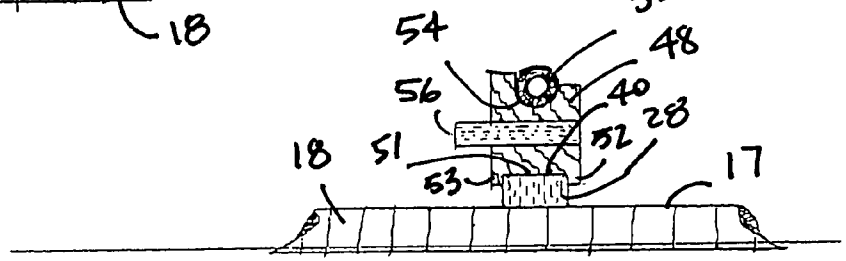
FIG. 5 is a section view taken along the line B—B of FIG. 3.

Referring to FIGS. 2, 3 and 5, a slider 48 is disposed between the transverse braces 21 and 22 and held in place between the top surface 40 of tapered fan brace 28 and the voicing bar 36 with which it is slidably disposed.

The end of slider 48 facing fan brace 28 includes a recessed surface 51 (contact surface) that engages the upper surface 40 of fan brace 28, while depending side members 52 and 53 keep the slider properly aligned as it moves on brace surface 40. The other end of slider 48 includes a circular recess 54 sized to receive the voicing bar 36. For ease of removal and replacement, the voicing bar 36 is not totally surrounded by the slider 48, as it is by the voicing shoe 41 (see FIG. 6), although such an embodiment would be satisfactory, as well.

The distance between the bottom of the circular recess 54 and the recess 51 is such that when the slider 48 is immediately adjacent to transverse brace 22, a small amount of pressure is applied to the fan brace 28. As the slider 48 is positioned away from transverse brace 22 and toward transverse brace 21, the pressure applied by slider 48 to the fan brace 28 increases by virtue of the increasing thickness of fan brace 28 (reduction in space between fan brace 28 and voicing bar 36). A bending moment is established at brace 21 between voicing shoe 41 and slider 48 by which the pressure applied by each is dependent on the other, even while they are independently adjustable along fan brace 28. The complex pressure forces at the transverse braces 21 and 22, the slider 48 and the shoe 41 are a function of the distance between the shoe 41 and slider 48 and the position of each on the fan brace. By adjusting the positions of shoe 41 and the slider 48, a wide variety of tension changes can be made in sounding board 18.

A peg 56 extending laterally from slider 48 provides a convenient handle for positioning the slider 48.

The embodiment of the invention as described above provides two points of variable pressure applied to the sounding board 18 at independently selectable locations on the fan brace 28.

Figure 7:
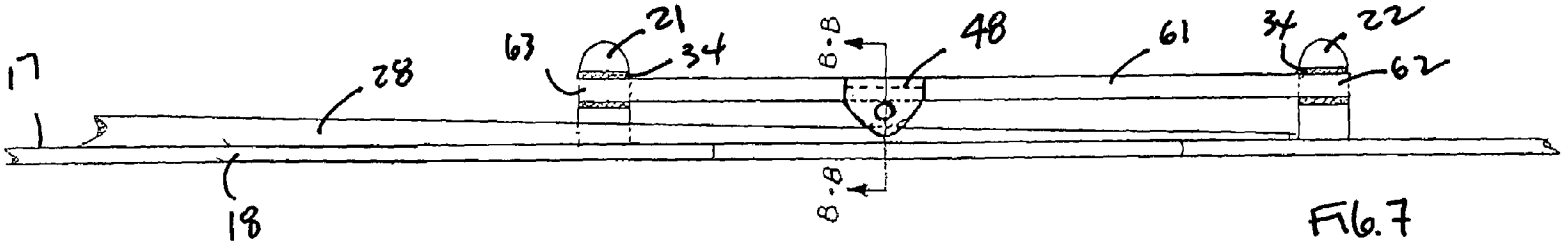
FIG. 7 is a partial side elevation of the sounding board of FIG. 2 illustrating an alternative embodiment of the invention.

Referring to FIG. 7, in a simplified embodiment of the invention, a voicing bar 61 is fixedly secured at its ends 62 and 63 in transverse braces 21 and 22, and not slidably secured, as in the case of voicing bar 36 (FIGS. 2 and 3). In this embodiment of the invention, the slider 48 provides the only source of variable pressure on the tapered fan brace 28 and thereby on the inner surface 17 of upper sounding board 18. As described above in connection with FIGS. 1–6, by positioning slider 48 along the voicing bar 61, the amount of pressure applied to the fan brace 28 can be varied, along with the tension of the sounding board 18.

Figure 8:
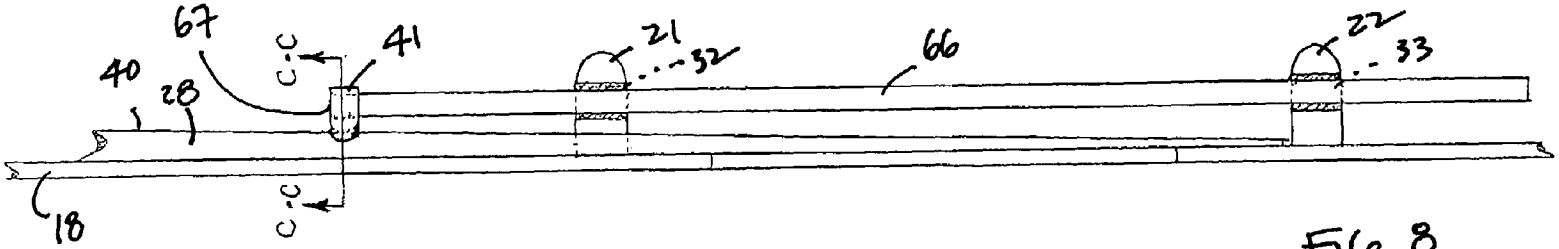
FIG. 8 is a partial side elevation of the sounding board of FIG. 2 illustrating another alternative embodiment of the invention.

Referring to FIG. 8, in another embodiment of the invention, a voicing bar 66 is slidably disposed in the bearing holes 32 and 33 in transverse braces 21 and 22, respectively, and has at its end 67 a voicing shoe 41 which engages the upper surface 40 of the fan brace 28, as previously described in connection with FIGS. 1–6. By sliding the voicing bar 66 and changing the position of voicing shoe 41 on fan brace 28, the location of pressure applied to the fan brace and thereby the upper sounding board 18 is varied. In this embodiment, the only pressure applied to the upper sounding board 18 is through shoe 41, there being no slider provided. As explained above, the pressure remains essentially constant for any position of voicing shoe 41 on fan brace 28.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. In an acoustical musical instrument having a top sounding board having an inner surface and a sound hole, the combination comprising:

a pair of spaced apart transverse braces secured to the inner surface of the sound board straddling the sound hole;

a generally longitudinally extending tapered fan brace secured to the inner surface of the sounding board;

a generally longitudinally extending voicing bar having a longitudinal axis and two ends and secured to said transverse braces and disposed generally parallel to the sounding board and over and spaced apart from said tapered fan brace; and pressure applying means disposed on said voicing bar applying pressure at selected positions on said fan brace.

2. The acoustical musical instrument of claim 1 wherein said pressure applying means comprises a slider slidably disposed on said voicing bar and having a contact surface that rides on said tapered fan brace whereby pressure is applied to said tapered fan brace by said slider in an amount dependant on the position of said slider on said tapered fan brace.

3. The acoustical musical instrument of claim 1 wherein said voicing bar is slidably secured to said transverse braces whereby it is movable along its longitudinal axis and wherein said pressure applying means comprises a voicing bar shoe secured at one end of said voicing bar and in contact with and applying pressure on said tapered fan brace.

4. The acoustical musical instrument of claim 3 wherein said pressure applying means further comprises a slider slidably disposed on said voicing bar having a contact surface that rides on said tapered fan brace whereby pressure is applied to said tapered fan brace by said slider in an amount dependant on the position of said slider on said tapered fan brace.

5. In an acoustical string instrument having, a top sounding board having an inner surface and a sound hole, the combination comprising:

a generally longitudinally extending fan brace secured to the inner surface of the sounding board;

pressure means applying pressure at selectable locations on said tapered fan brace.

6. The acoustical string instrument of claim 5 further comprising:

a pair of spaced apart transverse braces secured to the inner surface of the sounding board straddling the sound hole wherein said pressure means also applies pressure to said pair of spaced apart transverse braces.

7. The acoustical string instrument of claim 6 wherein said pressure means is operatively disposed between said pair of spaced apart transverse braces and said fan brace.

8. The acoustical string instrument of claim 5 wherein said pressure means applies varying pressure to said fan brace at selectable locations on said fan brace.

9. The acoustical string instrument of claim 6 wherein said pressure means applies varying pressure to said fan brace at selectable locations on said fan brace.

10. In an acoustical musical instrument having a top sounding board having an inner surface and a sound hole, the combination comprising:

pressure means applying pressure at selectable locations on the inner surface of the sounding board to vary the tension of the sounding board.

* * * * *